US010707563B2

(12) United States Patent
So et al.

(10) Patent No.: US 10,707,563 B2
(45) Date of Patent: Jul. 7, 2020

(54) MULTI-POLARIZED RADIATION ELEMENT AND ANTENNA HAVING SAME

(71) Applicant: KMW INC., Hwaseong-si (KR)

(72) Inventors: Sung-Hwan So, Hwaseong-si (KR); Hun-Jung Jung, Yongin-si (KR); Kwang-Seok Choi, Osan-si (KR); Jae-Jung Choi, Yongin-si (KR)

(73) Assignee: KMW INC., Hwaseong-si (KR)

( * ) Notice: Subject to any disclaimer, the term of this patent is extended or adjusted under 35 U.S.C. 154(b) by 12 days.

(21) Appl. No.: 15/915,087

(22) Filed: Mar. 8, 2018

(65) Prior Publication Data

US 2018/0198191 A1 Jul. 12, 2018

Related U.S. Application Data

(63) Continuation of application No. PCT/KR2016/010171, filed on Sep. 9, 2016.

(30) Foreign Application Priority Data

Sep. 11, 2015 (KR) ..... 10-2015-0129165

(51) Int. Cl.
*H01Q 1/24* (2006.01)
*H01Q 9/16* (2006.01)
(Continued)

(52) U.S. Cl.
CPC ..... *H01Q 1/246* (2013.01); *H01Q 5/40* (2015.01); *H01Q 9/16* (2013.01); *H01Q 13/08* (2013.01);
(Continued)

(58) Field of Classification Search
CPC ..... H01Q 9/16; H01Q 21/26; H01Q 21/0075; H01Q 21/065; H01Q 21/24; H01Q 1/246; H01Q 13/08
(Continued)

(56) References Cited

U.S. PATENT DOCUMENTS 6,034,649 A 3/2000 Wilson et al.
6,747,606 B2 6/2004 Harel et al.
(Continued)

FOREIGN PATENT DOCUMENTS

CN 1591976 A 3/2005
KR 10-2001-0042252 A 5/2001
(Continued)

OTHER PUBLICATIONS

International Search Report for PCT/KR2016/010171, dated Dec. 19, 2016, and its English translation.
(Continued)

*Primary Examiner* — Ricardo I Magallanes

(57) ABSTRACT

A multi-polarized radiating element of the present disclosure includes first, second, third, and fourth radiating arms arranged in a four-way symmetrical manner on a plane; a first feeding line commonly fed to the fourth radiating arm and the first radiating arm, and commonly grounded to the second radiating arm and the third radiating arm; and a second feeding line commonly fed to the first radiating arm and the second radiating arm, and commonly grounded to the third radiating arm and the fourth radiating arm.

9 Claims, 17 Drawing Sheets

(51) Int. Cl.

| | |
|---|---|
| ***H01Q 5/40*** | (2015.01) |
| ***H01Q 13/08*** | (2006.01) |
| ***H01Q 21/24*** | (2006.01) |
| ***H01Q 19/10*** | (2006.01) |
| ***H01Q 21/00*** | (2006.01) |
| ***H01Q 21/26*** | (2006.01) |

(52) U.S. Cl.
CPC ..... *H01Q 19/108* (2013.01); *H01Q 21/0025* (2013.01); *H01Q 21/0075* (2013.01); *H01Q 21/24* (2013.01); *H01Q 21/26* (2013.01)

(58) Field of Classification Search
USPC ..... 343/797, 808, 799, 796, 879, 795, 810
See application file for complete search history.

(56) References Cited

U.S. PATENT DOCUMENTS

| | | | | |
|---|---|---|---|---|
| 8,068,066 | B2 * | 11/2011 | Perkins, III | H01Q 21/29 343/797 |
| 8,325,101 | B2 * | 12/2012 | Payne | H01Q 21/205 343/797 |
| 2008/0074339 | A1 | 3/2008 | Lee et al. | |
| 2011/0001678 | A1 * | 1/2011 | Hsu | H01Q 21/065 343/848 |
| 2013/0307743 | A1 * | 11/2013 | Moon | H01Q 1/246 343/833 |
| 2014/0071006 | A1 * | 3/2014 | Chan | H01Q 9/0407 343/730 |
| 2016/0294065 | A1 * | 10/2016 | Lindmark | H01Q 13/10 |
| 2017/0149145 | A1 * | 5/2017 | Payne | H01Q 21/26 |

FOREIGN PATENT DOCUMENTS

| | | | |
|---|---|---|---|
| KR | 10-2002-0022071 | A | 3/2002 |
| KR | 10-0865749 | B1 | 10/2008 |
| KR | 10-2010-0033888 | A | 3/2010 |
| KR | 10-2012-0086836 | A | 8/2012 |
| KR | 10-2012-0088471 | A | 8/2012 |
| KR | 10-1485465 | B1 | 1/2015 |
| WO | 2015/107473 | A1 | 7/2015 |

OTHER PUBLICATIONS

Extended Search Report dated Apr. 1, 2019 for European Application No. 16844734.0.

* cited by examiner

MULTI-POLARIZED RADIATION ELEMENT AND ANTENNA HAVING SAME

CROSS-REFERENCE TO RELATED APPLICATIONS

This application is a Continuation of International Application No. PCT/KR2016/010171, filed on Sep. 9, 2016, which claims the benefit of and priority to Korean Patent Application No. 10-2015-0129165, filed on Sep. 11, 2015, the content of which are herein incorporated by reference in their entirety.

TECHNICAL FIELD

The present disclosure relates to a wireless communication antenna used in a base station or a repeater, etc. of a wireless communication (PCS, Cellular, CDMA, GSM, LTE, etc.) system (hereinafter, referred to as 'antenna'), and more particularly, to a radiating element for generating multi-polarized waves and an antenna having the same.

BACKGROUND ART

A radiating element used in an antenna of a base station, including a repeater of a wireless communication system, is applied with various types of radiating elements, such as a patch type and a dipole type. Among them, the dipole-type radiating element has two radiating arms forming the poles corresponding to each other, and generally, the length of each pole (radiating arm) is set as ¼λ (λ: wavelength) of the wavelength of the used frequency, and a total length of the two radiating arms is composed of ½λ. Recently, the wireless communication antenna is generally implemented as a dual-polarized antenna structure by applying a polarized diversity manner, and the dipole-type radiating element is widely used for the dual-polarized antenna because the structure for generating two (orthogonal) polarized waves is easily implemented and the arrangement of the radiating element is easy.

FIGS. 1A to 1C are configuration views of a general dipole-type radiating element; and FIG. 1A illustrates a physical model thereof, FIG. 1B illustrates an equivalent structure indicating a current flow path in FIG. 1A and FIG. 1C illustrates current distribution in FIG. 1A. The dipole-type radiating element illustrated in FIGS. 1A to 1C is implemented as one dipole element, and forms a balun structure using a structure of a basic coaxial line 11. An inner conductor 112 of the coaxial line 11 is connected with a first radiating arm 122, and an outer conductor 114 is connected with a second radiating arm 124 to overall implement a half-wave dipole-type radiating element.

FIG. 2 is a first exemplary configuration view of the conventional dipole-type dual-polarized radiating element, and illustrates the structure that can be seen as a basic model of a dual-polarized radiating element generating a so-called 'X-polarized wave'. The dual-polarized radiating element in FIG. 2 is the structure that two dipole elements of the structure illustrated in FIGS. 1A to 1C are perpendicular to each other at an angle of 90 degrees, and can be overall implemented as a 'X' shape. That is, a first dipole element is composed of a 1-1 radiating arm 222 connected with an inner conductor 212 of the first coaxial line and a 1-2 radiating arm 224 connected with an outer conductor 214 of the first coaxial line, and is installed at an angle of +45 degrees with respect to the vertical axis (or the horizontal axis). A second dipole element is composed of a 2-1 radiating arm 322 connected with an inner conductor 312 of the second coaxial line and a 2-2 radiating arm 324 connected with an outer conductor 314 of the second coaxial line, and is installed at an angle of −45 degrees with respect to the vertical axis (or the horizontal axis). In this case, the first coaxial line and the second coaxial line are configured to receive a feeding signal as a separate signal source, respectively. Examples of the dipole-type dual-polarized antenna are disclosed in the U.S. Pat. No. 6,034,649 (Title: "DUAL POLARIZED BASED STATION ANTENNA," Registered Date: Mar. 7, 2000) by 'Andrew Corporation,' or the Korean Patent Application No. 2000-7010785 first filed by 'Kathrein-Verke AG' (Title: "DUAL-POLARIZED MULTI-BAND ANTENNA," Filed Date: Sep. 28, 2000).

The dipole-type dual-polarized antenna as illustrated in FIG. 2, as the shape corresponding to a basic model, is proposed as various structures for balun and feeding structures, etc., including the radiating arms of the dipole element, considering the enhancement of radiating performance, the improvement of broadband or narrowband radiating characteristics, the optimized size and shape, the manufacturing process and the installation costs, etc. For example, as illustrated by the dotted line in FIG. 2, particularly, the radiating arms of the dipole element can have various structures, such as a ring shape of a square, or a plate shape of a square, or a ribbon shape, etc. as well as simply a linear rod shape.

FIG. 3 is a second exemplary configuration view of the conventional dipole-type dual-polarized radiating element, and proposes the structure that modifies the structure of the radiating arms and the feeding structure in comparison with FIG. 2. The dipole-type dual-polarized radiating element illustrated in FIG. 3 is implemented by first and second dipole elements that are perpendicular to each other in a 'X' shape, a first dipole element includes the 1-1 and 1-2 radiating arms 242, 244, and a second dipole element includes the 2-1 and 2-2 radiating arms 342, 344. In this case, it is illustrated that the radiating arms 242, 244, 342, 344 of the first and second dipole elements have, for example, a plate shape of a square in order to have the characteristic of the broadband.

Furthermore, the feeding structures of the first and second dipole elements do not have the structure using the coaxial line as illustrated in FIG. 2, but have a structure of a stripline transmission line. That is, in the structure illustrated in FIG. 3, feeding conductor portions of the feeding lines are composed of first and second striplines 232, 332. The first stripline 232 is placed along a support fixture of a balun structure forming a ground portion of the feeding line while supporting the 1-1 radiating arm 242, the first stripline 232 is extended to a support fixture of the 1-2 radiating arm 244 to deliver, for example, a feeding signal to the 1-2 radiating arm 244 in a capacitance coupling manner. Likewise, the second stripline 332 is placed along a support fixture of the balun structure supporting the 2-1 radiating arm 342, and is extended to a support fixture of the 2-2 radiating arm 344 to deliver a feeding signal to the 2-2 radiating arm 344.

FIGS. 4A to 4D are third exemplary configuration views of the conventional dipole-type dual-polarized radiating element; and FIG. 4A is a plane view, FIG. 4B is a perspective view seen at an upper side thereof, FIG. 4C is a perspective view seen at a lower side thereof, and FIG. 4D is a separate perspective view with respect to the striplines of FIGS. 4A to 4C. The dual-polarized radiating elements illustrated in FIGS. 4A to 4D are composed of a first dipole element including the 1-1 and 1-2 radiating arms 262, 264 and a second dipole element including the 2-1 and 2-2 radiating arms 362, 364. In this case, the radiating arms 262, 264, 362, 364 of the first and second dipole elements have the structure adding the structure of a ring shape of a square to the structure illustrated in FIG. 2, for example, in order to have the characteristic of the broadband to thus overall have the structure of a square shape.

The feeding structures of the first and second dipole elements illustrated in FIGS. 4A to 4D have the structure of the stripline transmission line as illustrated in FIG. 3. That is, the first stripline 252 is placed in the shape that is extended from the support fixture of the 1-1 radiating arm 262 to the support fixture of the 1-2 radiating arm 264 to deliver a feeding signal to the 1-2 radiating arm 264. Likewise, a second stripline 352 is placed in the shape that is extended from the support fixture of the 2-1 radiating arm 362 to the support fixture of the 2-2 radiating arm 364 to deliver a feeding signal to the 2-2 radiating arm 364. In this case, as more clearly illustrated in FIG. 4D, the intersection of the first and second striplines 252, 352 is installed in the shape of an air bridge in order not to be connected with each other.

FIG. 5 illustrates a plane structure as a fourth exemplary configuration view of the conventional dipole-type dual-polarized radiating element. The dual-polarized radiating element illustrated in FIG. 5 is composed of a first dipole element including 1-1 and 1-2 radiating arms 282, 284, and a second dipole element including 2-1 and 2-2 radiating arms 382, 384. In this case, each of the radiating arms 282, 284, 382, 384 of the first and second dipole elements has a '¬' shape that is bent at the center of the plane structure thereof; and each of the bent portions is sequentially adjacent to each other and has the structure that is overall arranged in the '卐' shape in a four-way symmetrical manner on a plane. That is, each of the radiating arms 282, 284, 382, 384 can have the structure similar to that of two sub-radiating arms connected to each other at an angle of 90 degrees.

Furthermore, the feeding structures of the first and second dipole elements have the structure of the stripline transmission line as illustrated in FIGS. 3 and 4; and a first stripline 272 is placed in the shape that is extended from a support fixture provided in the bent portion of the 1-1 radiating arm 282 to a support fixture provided in the bent portion of the 1-2 radiating arm 284. Likewise, a second stripline 372 is placed in the shape that is extended from a support fixture provided in the bent portion of the 2-1 radiating arm 382 to a support fixture provided in the bent portion of the 2-2 radiating arm 384.

Examples of the dipole-type dual-polarized antenna having the structure illustrated in FIG. 5 can be disclosed in the Korean Patent Application No. 2011-9834 first filed by the Applicant of the present disclosure (Title: "DUAL-POLARIZED ANTENNA FOR WIRELESS COMMUNICATION BASE STATION AND MULTI-BAND ANTENNA SYSTEM USING THE SAME," Date of Patent: Jun. 8, 2004), or the U.S. Pat. No. 6,747,606 (Title: SINGLE OR DUAL POLARIZED MOLDED DIPOLE ANTENNA HAVING INTEGRATED FEED STRUCTURE," Registered Date: Jun. 8, 2004) by 'Radio Frequency Systems'.

As described above, in order to implement the multi-polarized radiating element, various researches have been currently proceeded considering the radiating performance and characteristics, the shape and size, the manufacturing manner, ease of design, etc. Particularly, various structures for balun and feeding structures including the radiating arms of the dipole element have been proposed.

DISCLOSURE

Technical Problem

In at least some embodiments of the present disclosure, a multi-polarized radiating element and an antenna having the same are provided to have a more optimized structure and the optimization of a size, a more stable radiating characteristic of the antenna, and ease of antenna design.

Particularly, in the at least some embodiments of the present disclosure, when a plurality of the radiating elements have been placed by minimizing the volume of the radiating element, the multi-polarized radiating element and the antenna having the same are provided to minimize the influence between the placed radiating elements, thus enhancing the overall characteristics of the antenna.

Technical Solution

In order to achieve the object, in some embodiments of the present disclosure, a multi-polarized radiating element is characterized by including first, second, third, and fourth radiating arms arranged in a four-way symmetrical manner on a plane; a first feeding line fed in common to the fourth radiating arm and the first radiating arm, and grounded in common to the second radiating arm and the third radiating arm; and a second feeding line fed in common to the first radiating arm and the second radiating arm, and grounded in common to the third radiating arm and the fourth radiating arm.

Each of the first to fourth radiating arms can be configured to be individually supported by a support fixture forming a balun structure, and the support fixtures supporting the first to fourth radiating arms can be installed to be spaced at a pre-designed interval apart from each other.

The first feeding line and the second feeding line can be configured using a structure of a stripline transmission line having a first stripline and a second stripline as a feeding conductor portion, respectively. In this case, the first stripline can be configured to be installed in the shape that is placed between the support fixture of the second radiating arm and the support fixture of the third radiating arm, and to be extended between the support fixture of the fourth radiating arm and the support fixture of the first radiating arm to deliver a feeding signal in common to the fourth radiating arm and the first radiating arm in a capacitance coupling method. Furthermore, the second stripline can be configured to be installed in the shape that is placed between the support fixture of the third radiating arm and the support fixture of the fourth radiating arm, and to be extended between the support fixture of the first radiating arm and the support fixture of the second radiating arm to deliver a feeding signal in common to the first radiating arm and the second radiating arm in a capacitance coupling method.

The arrangements of the first to fourth radiating elements can overall indicate a 'V' shape on a plane.

In another some embodiments of the present disclosure, an antenna having a multi-polarized radiating element is characterized by including a reflector; at least one first radiating element of a first band installed on the reflector; and at least one second or third radiating element of a second band or a third band installed on the reflector; and the first radiating element is characterized by including first, second, third, and fourth radiating arms arranged in a four-way symmetrical manner on a plane; a first feeding line fed in common to the fourth radiating arm and the first radiating arm, and grounded in common to the second radiating arm and the third radiating arm; and a second feeding line fed in common to the first radiating arm and the second radiating arm, and grounded in common to the third radiating arm and the fourth radiating arm.

Advantageous Effects

As described above, the multi-polarized radiating element in accordance with at least some embodiments of the present disclosure can implement a more optimized structure and the optimization of a size, and have a more stable radiating characteristic of the antenna and ease of the antenna design. Particularly, the at least some embodiments of the present disclosure can minimize the influence between the placed radiating elements when a plurality of the radiating elements have been placed by minimizing a volume of the radiating element, thus enhancing the overall characteristics of the antenna.

BEST MODE

Hereinafter, the preferred embodiment in accordance with the present disclosure will be described in detail with reference to the accompanying drawings. In the following description, specific details such as the detailed components are introduced, but it will be apparent to those skilled in the art that the specific details are provided to facilitate understanding of the present disclosure and specific modifications to and variation in those specific details may be made without departing from the scope of the present disclosure.

Figure 6:
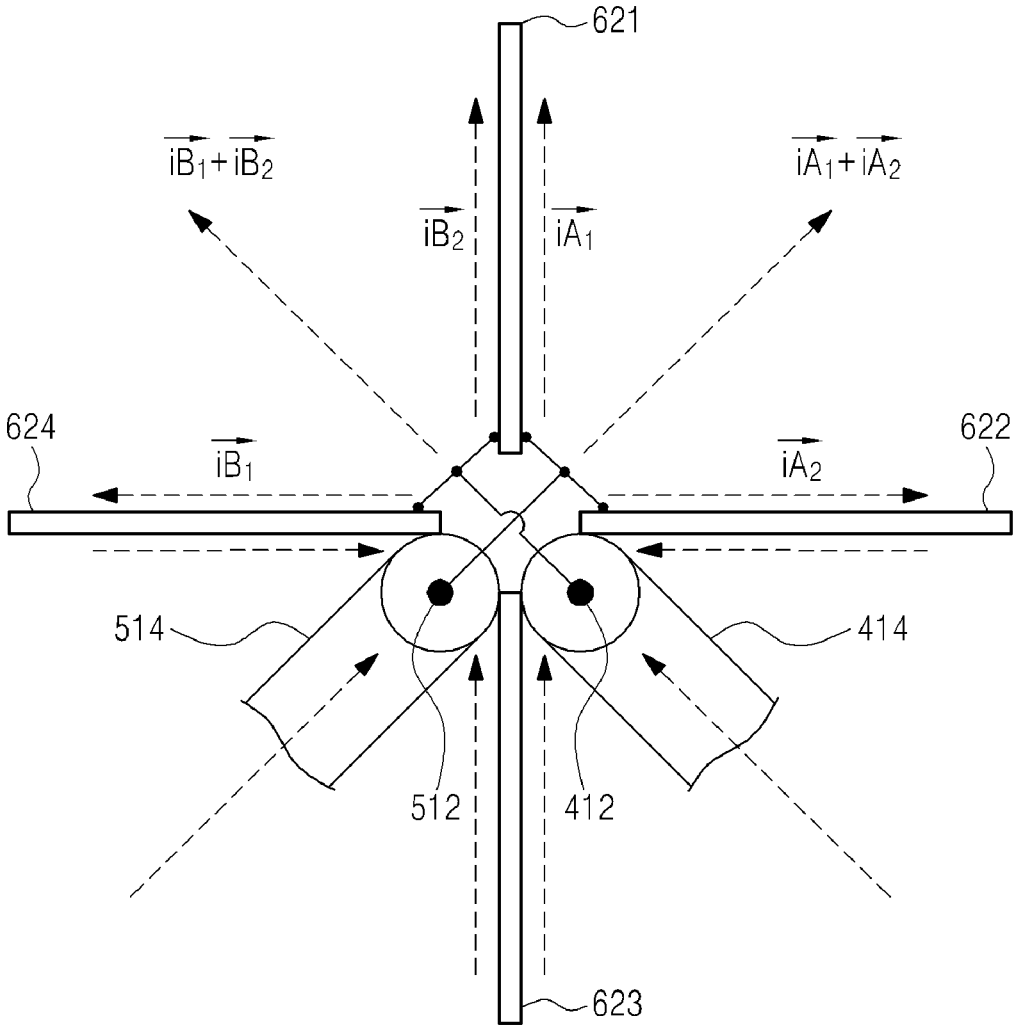
FIG. 6 is a configuration view of a dipole-type dual-polarized radiating element in accordance with a first embodiment of the present disclosure.

FIG. 6 is a configuration view of the dipole-type dual-polarized radiating element in accordance with a first embodiment of the present disclosure, and illustrates the structure that can be seen as a basic model in accordance with the characteristics of the present disclosure of the radiating element generating dual-polarized waves of X-polarized wave. The dual-polarized radiating element in accordance with the first embodiment of the present disclosure illustrated in FIG. 6 is, for example, configured to include first, second, third, and fourth radiating arms 621, 622, 623, 624 arranged in a four-way symmetrical manner on a plane in the top, bottom, left, and right directions to overall indicate a 'V' shape; a first feeding line fed in common to the fourth radiating arm 624 and the first radiating arm 621, and grounded in common to the second radiating arm 622 and the third radiating arm 623; and a second feeding line fed in common to the first radiating arm 621 and the second radiating arm 622, and grounded in common to the third radiating arm 623 and the fourth radiating arm 624. The first feeding line and the second feeding line are configured to receive a feeding signal as a separate signal source, respectively. Furthermore, the length of each of the radiating arms 621 to 624 is set as ¼λ (λ: wavelength) of the wavelength of the used frequency, and a total length of two radiating arms on the same axis (the vertical axis or the horizontal axis) can be composed of ½λ.

In the example of FIG. 6, the first and second feeding lines form a balun structure using a basic coaxial line structure. Accordingly, an inner conductor 412 of the first feeding line is connected in common with the fourth and the first radiating arms 624, 621, and an outer conductor 414 of the first feeding line is connected in common with the second and third radiating arms 622, 623. Furthermore, the inner conductor 512 of the second feeding line is connected in common with the first and second radiating arms 621, 622, and the outer conductor 514 of the second feeding line is connected in common with the third and fourth radiating arms 623, 624.

As described in FIG. 6, the conventional dipole-type dual-polarized radiating element basically has a structure in which a separate feeding line for each one dipole element is provided, but it will be understood that in the embodiments of the present disclosure, for example, the feeding conductor portion of the first feeding line is connected in common to any two radiating arms adjacent to each other among the four radiating arms, and the ground portion of the first feeding line is connected in common to the other two radiating arms. Furthermore, the feeding conductor portion of the second feeding line is connected in common with any selected radiating arm of two radiating arms to which the feeding conductor portion of the first feeding line is connected in common, and the radiating arm adjacent to the selected radiating arm (the radiating arm to which the feeding conductor portion of the first feeding line is not connected in common). Furthermore, the ground portion of the second feeding line is connected in common with the other two radiating arms excluding two radiating arms to which the feeding conductor portion of the corresponding second feeding line is connected in common.

An arrow in FIG. 6 indicates one example of current flow by the first to fourth radiating arms 621 to 624, and the first and second radiating arms 621, 622 are fed in common by the second feeding line 512, 514 to form current ($iA_1$, $iA_2$) paths along the first and second radiating arms 621, 622. A current ($iA_1$+$iA_2$) path for forming the polarized wave in the direction in accordance with a vector sum of the current ($iA_1$, $iA_2$) paths formed along the first and second radiating arms 621, 622, for example, in the direction at an angle of +45 degrees with respect to the vertical axis is formed. Likewise, the fourth and first radiating arms 624, 621 are fed in common by the first feeding line 412, 414 to form current ($iB_1$, $iB_2$) paths along the fourth and first radiating arms 624, 621. A current ($iB_1$+$iB_2$) path for forming the polarized wave in the direction in accordance with a vector sum of the current ($iB_1$, $iB_2$) paths formed along the fourth and first radiating arms 624, 621, for example, in the direction at an angle of −45 degrees with respect to the vertical axis is formed.

Through the structure, the polarized wave at an angle of +45 degrees with respect to the vertical axis among the 'X' polarized waves is eventually generated by the second feeding line, a combination of the first and second radiating arms 621, 622, and a combination of the third and fourth radiating arms 623, 624, and the polarized wave at an angle of −45 degrees with respect to the vertical axis among the 'X' polarized waves is generated by the first feeding line, a combination of the fourth and first radiating arms 624, 621, and a combination of the second and third radiating arms 622, 623.

Figure 7A:
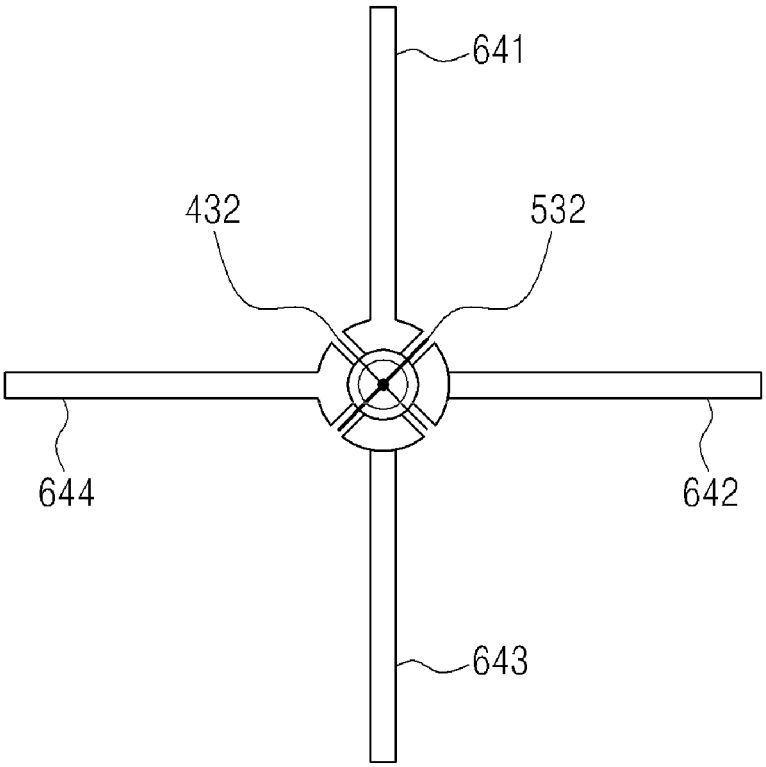
FIGS. 7A to 7D are configuration views of the dipole-type dual-polarized radiating element in accordance with a second embodiment of the present disclosure.
Figure 7B:
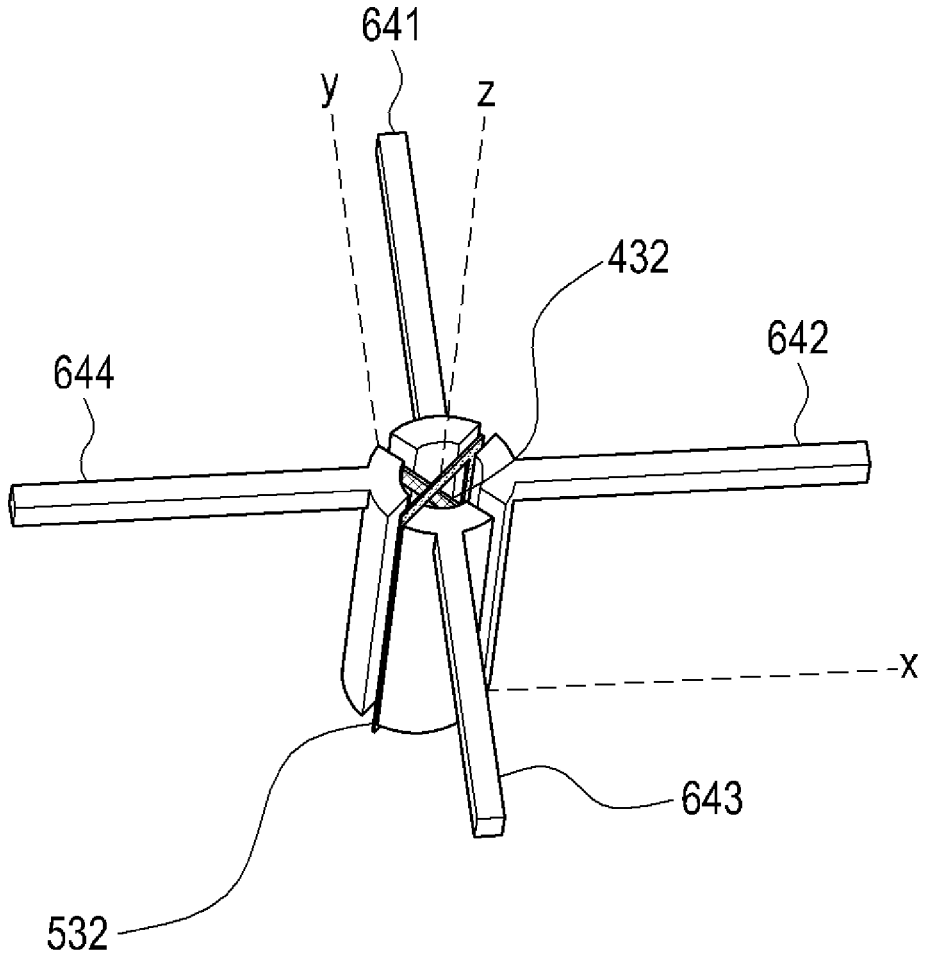
Figure 7C:
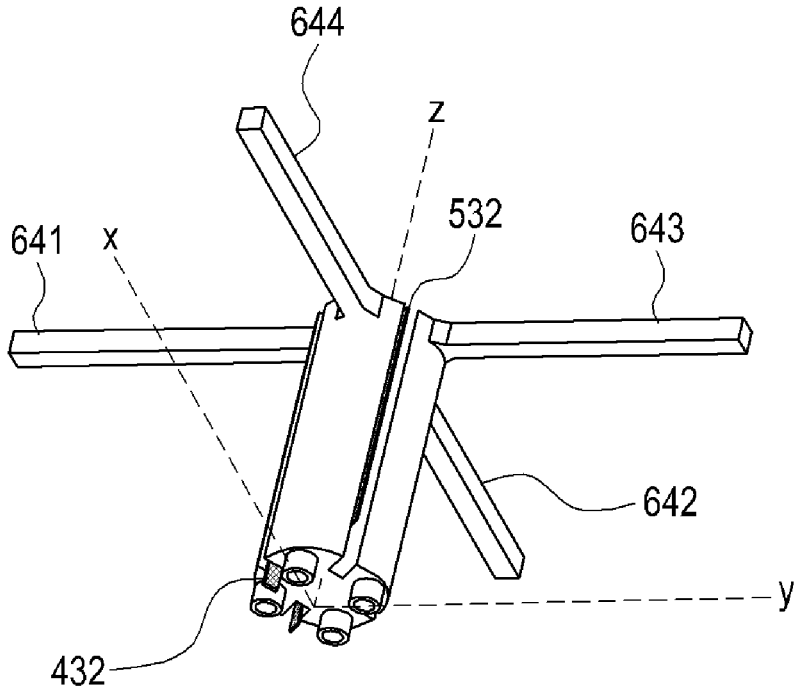
Figure 7D:
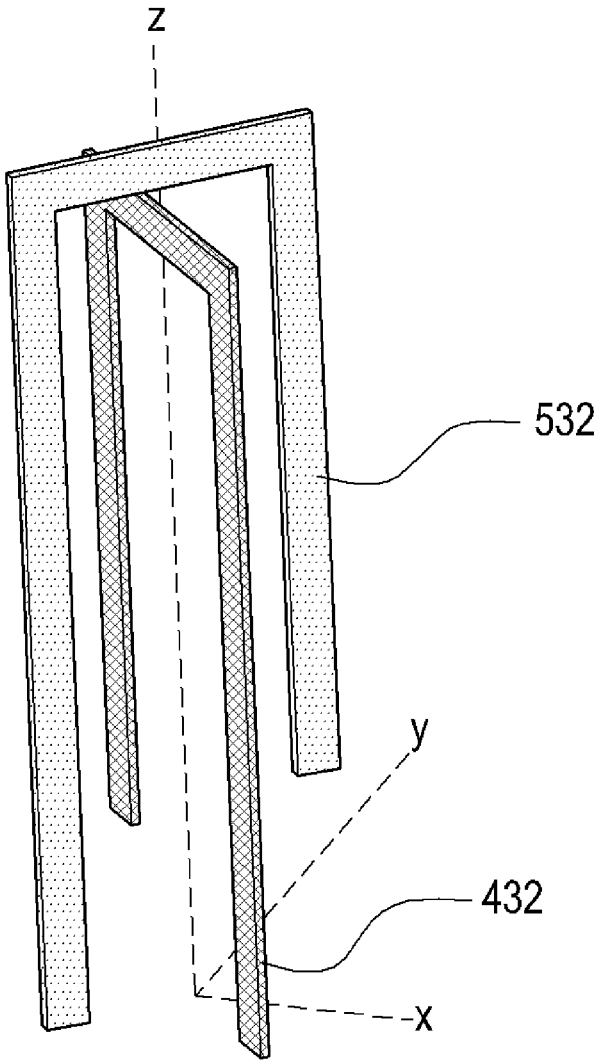

FIGS. 7A to 7D are configuration views of the dipole-type dual-polarized radiating element in accordance with a second embodiment of the present disclosure; and FIG. 7A is a plane view, FIG. 7B is a perspective view seen at an upper side thereof, FIG. 7C is a perspective view seen at a lower side thereof, and FIG. 7D is a separate perspective view with respect to the striplines of FIGS. 7A to 7C. The dual-polarized radiating element in accordance with the second embodiment of the present disclosure illustrated in FIGS. 7A to 7D, similar to the embodiment illustrated in FIG. 6, for example, is configured to include first, second, third, and fourth radiating arms 641, 642, 643, 644 overall indicating a 'V' shape; a first feeding line fed in common to the fourth radiating arm 644 and the first radiating arm 641, and grounded in common to the second radiating arm 642 and the third radiating arm 643; and a second feeding line fed in common to the first radiating arm 641 and the second radiating arm 642, and grounded in common to the third radiating arm 643 and the fourth radiating arm 644.

In this case, the first and second feeding lines illustrated in FIGS. 7A to 7D are configured using the structure of the stripline transmission line, not the structure using the coaxial line as illustrated in FIG. 6. That is, in the structure illustrated in FIGS. 7A to 7D, the feeding conductor portions of the feeding lines are composed of the first and second striplines 432, 532. Each of the first to fourth radiating arms 641 to 644 is configured to be individually supported by a support fixture forming a balun structure, and the support fixtures supporting the first to fourth radiating arms 641 to 644 are installed to be spaced at an appropriately pre-designed interval apart from each other.

The first stripline 432 is configured to be installed to be placed in the shape that is spaced at the same interval apart from two support fixtures between the support fixture of the second radiating arm 642 and the support fixture of the third radiating arm 643; and to be extended between the support fixture of the fourth radiating arm 644 and the support fixture of the first radiating arm 641 to deliver a feeding signal in common to the fourth radiating arm 644 and the first radiating arm 641 in a capacitance coupling method. Likewise, the second stripline 532 is configured to be installed to be placed in the shape that is spaced at the same interval apart from two support fixtures between the support fixture of the third radiating arm 643 and the support fixture of the fourth radiating arm 644, and to be extended between the support fixture of the first radiating arm 641 and the support fixture of the second radiating arm 642 to deliver a feeding signal in common to the first radiating arm 641 and the second radiating arm 642 in a capacitance coupling method. In this case, as more clearly illustrated in FIG. 7D, the intersection between the first and second striplines 432, 532 is installed to be spaced at a constant interval apart from each other in the shape of an air bridge in order not to be connected with each other. In this case, in order to easily install the first and second striplines 432, 532 while maintaining the first and second striplines 432, 532 at an exact separation interval between the support fixtures of the radiating arms, a spacer (not shown) of a suitable shape of an insulating material, etc. can be further installed.

In the structure illustrated in FIGS. 7A to 7D, the upright lengths of the support fixtures supporting each of the radiating arms 621 to 624 can be set as ¼λ of the wavelength of the used frequency. In FIGS. 7A to 7D, the examples that the support fixtures supporting each of the radiating arms 621 to 624 are configured to have lower ends thereof connected to each other are illustrated, and these are for easily performing mutual alignments between the corresponding radiating arms 621 to 624 and the installation of the radiating elements composed of the radiating arms; and in other embodiments, each of the radiating arms 621 to 624 can be also individually installed (e.g., on a reflector of the antenna).

Figure 1A:
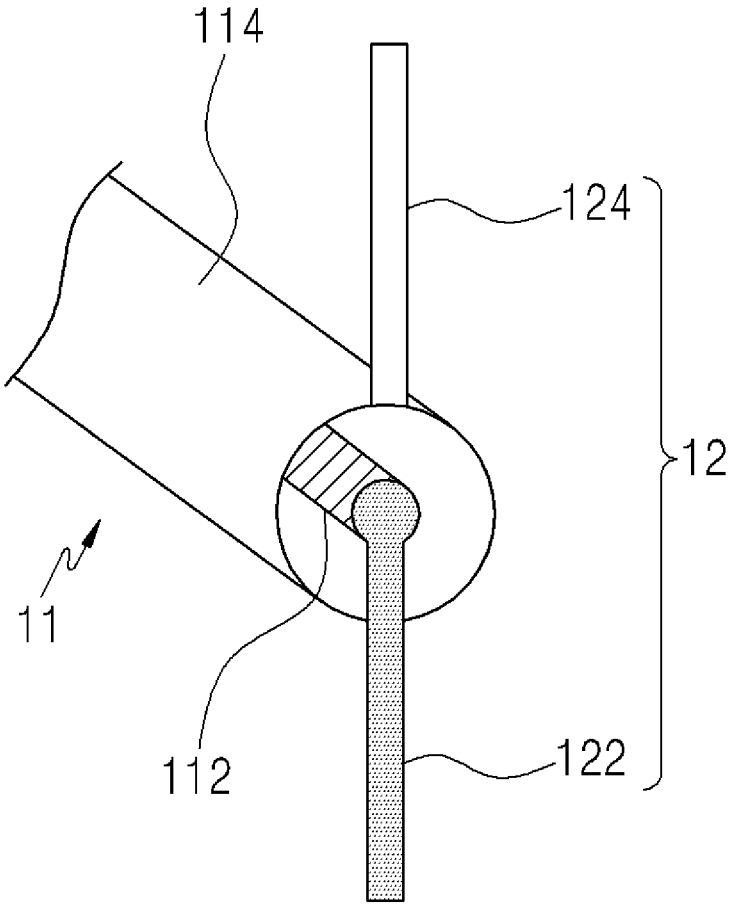
FIGS. 1A to 1C are configuration views of a general dipole-type radiating element.
Figure 1B:
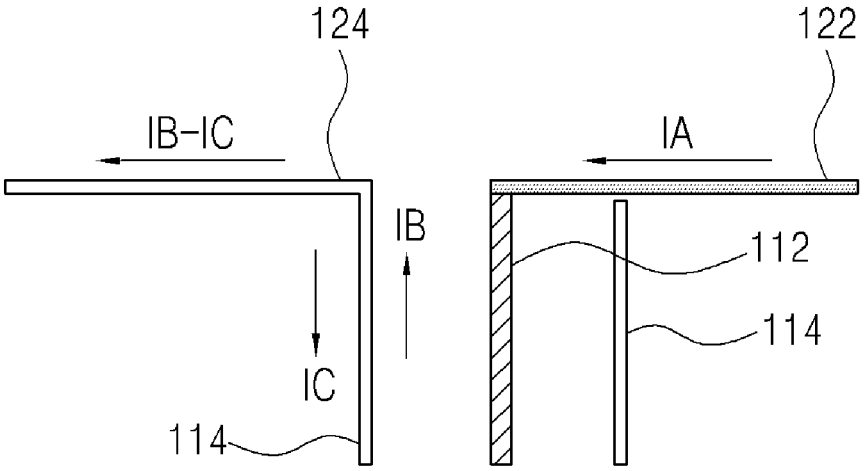
Figure 1C:
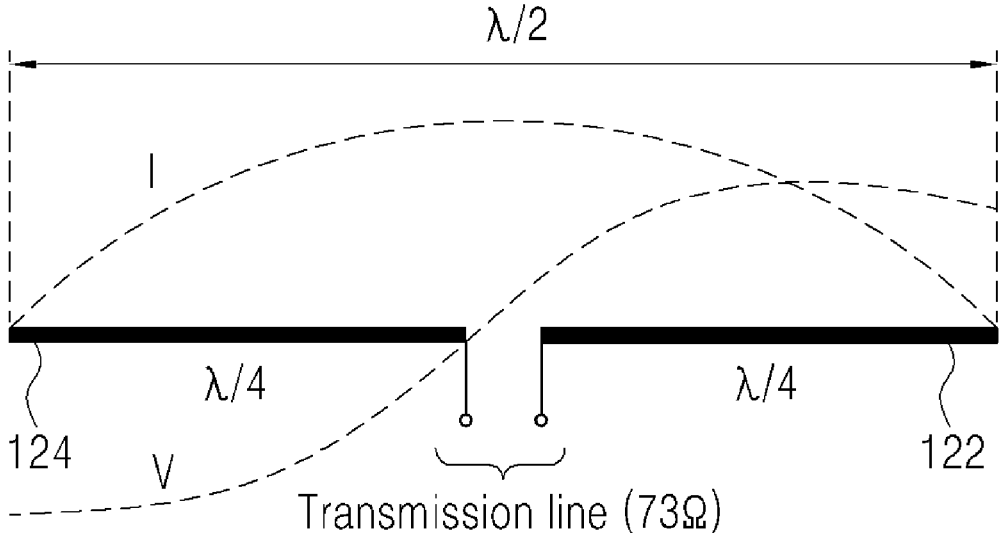
Figure 2:
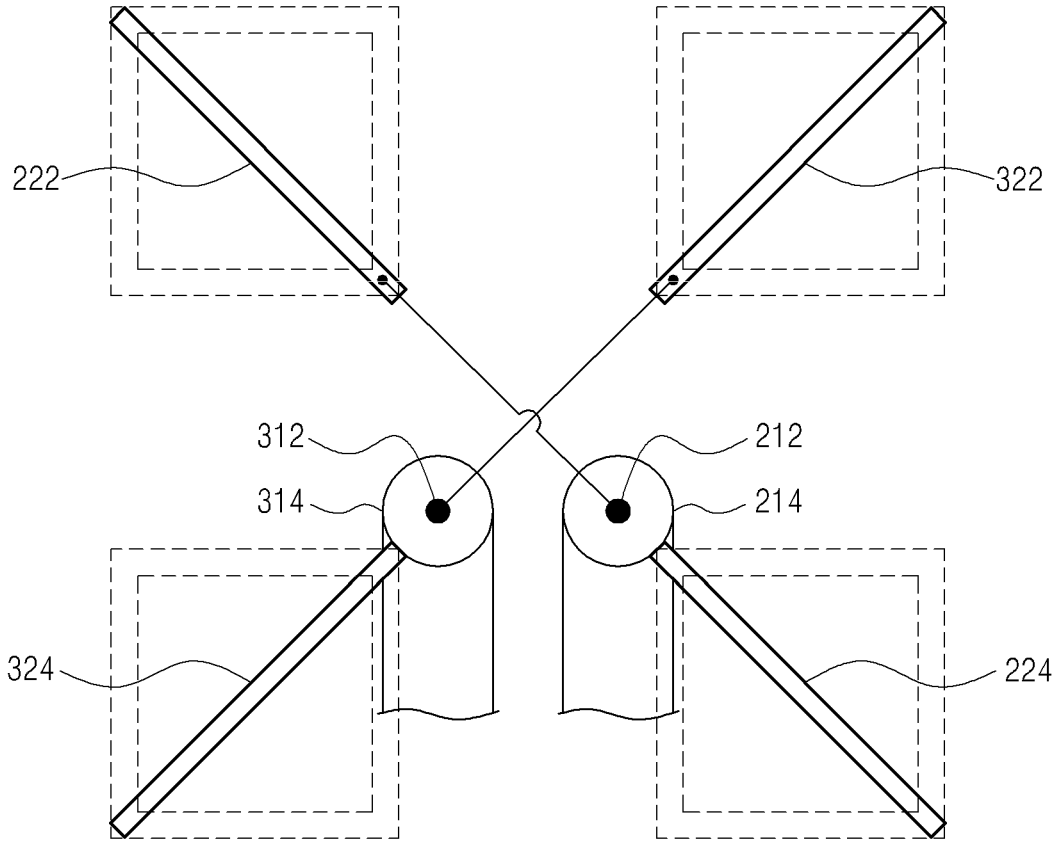
FIG. 2 is a first exemplary configuration view of a conventional dipole-type dual-polarized radiating element.
Figure 3:
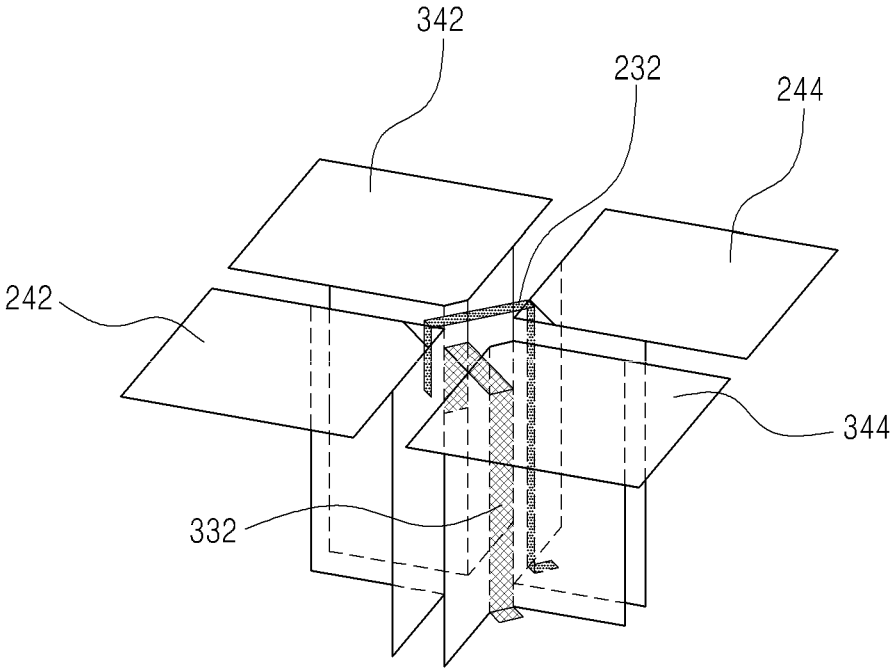
FIG. 3 is a second exemplary configuration view of the conventional dipole-type dual-polarized radiating element.
Figure 4A:
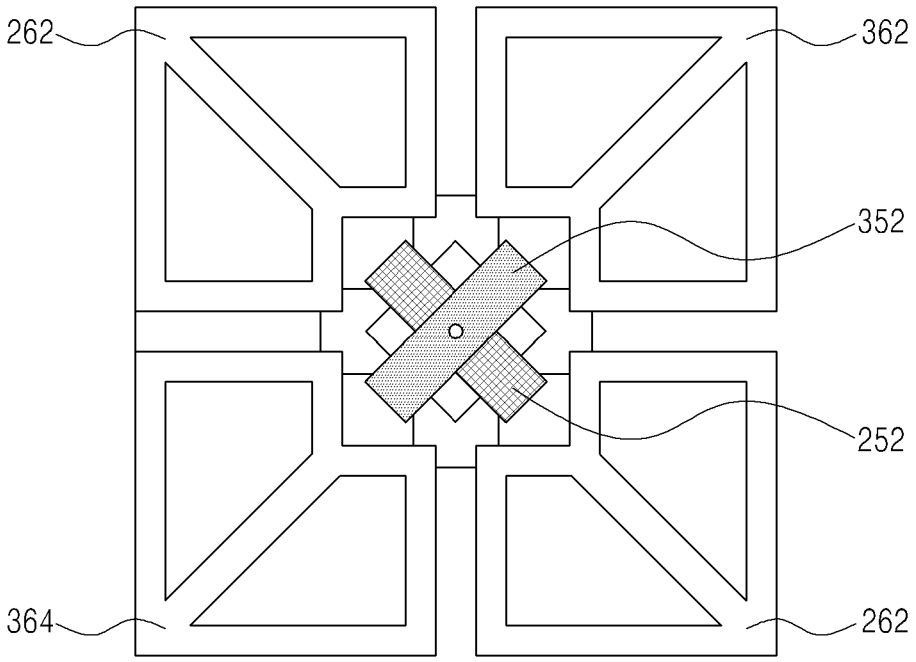
FIGS. 4A to 4D are third exemplary configuration views of the conventional dipole-type dual-polarized radiating element.
Figure 4B:
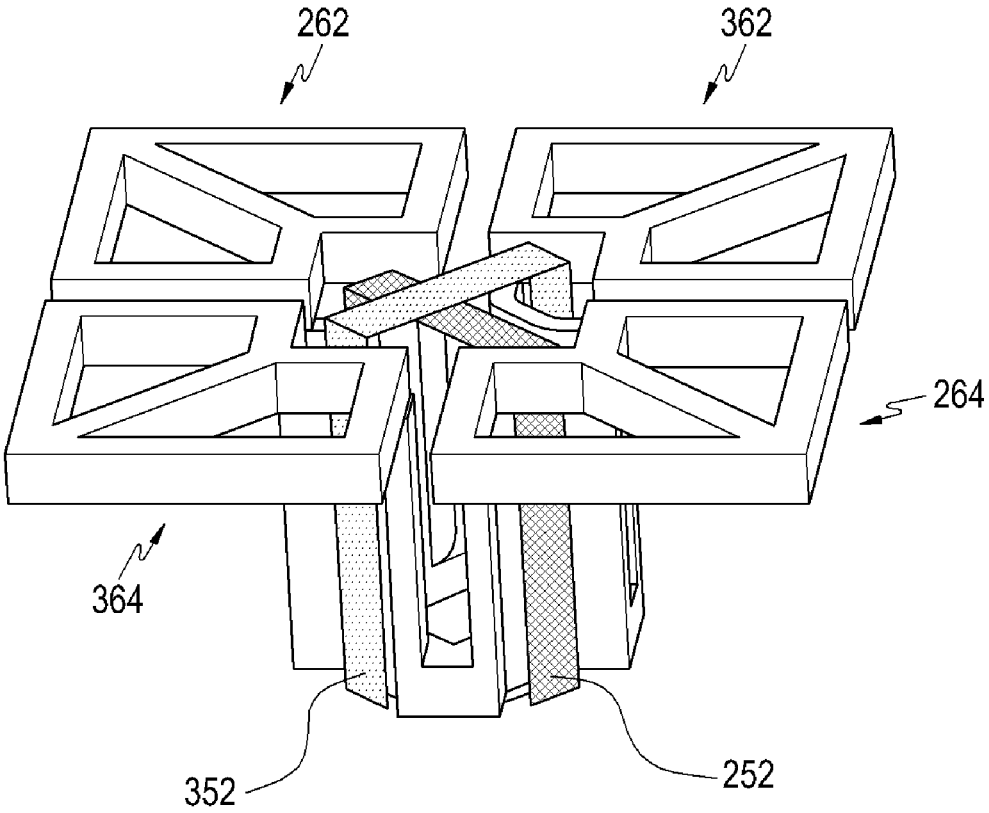
Figure 4C:
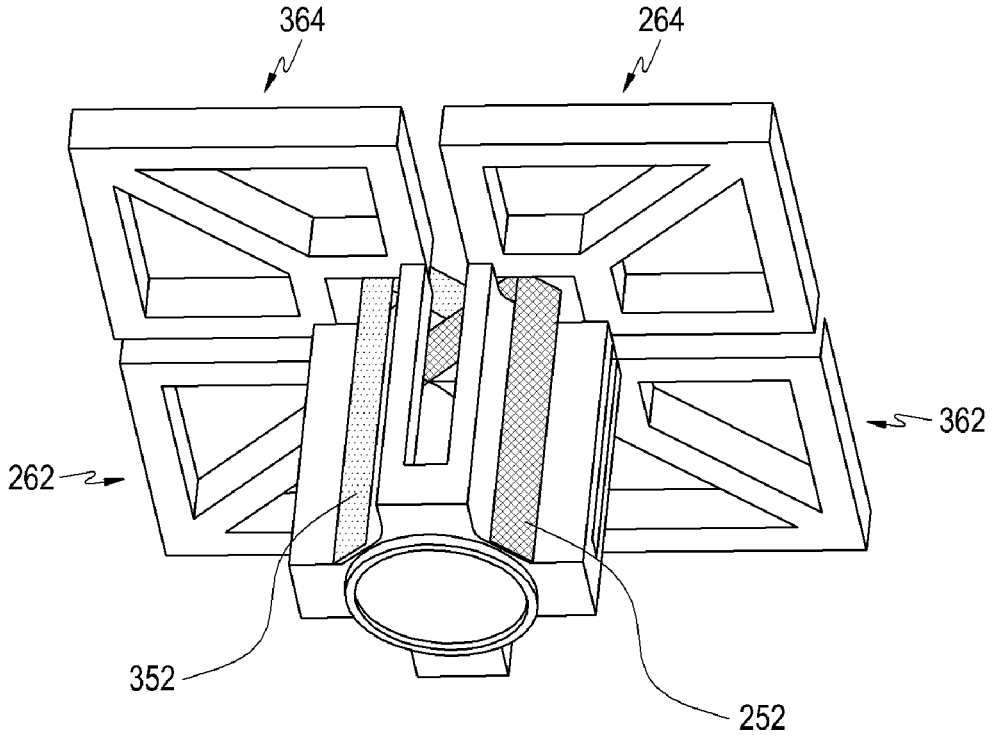
Figure 4D:
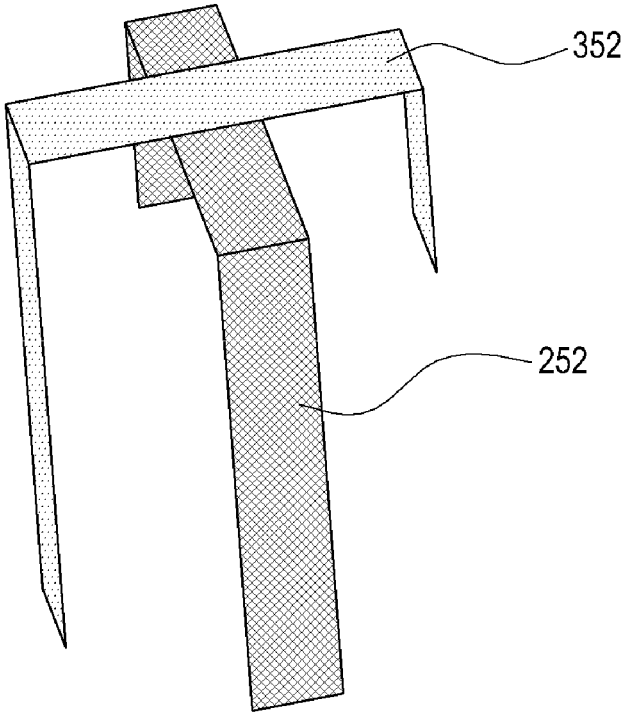
Figure 5:
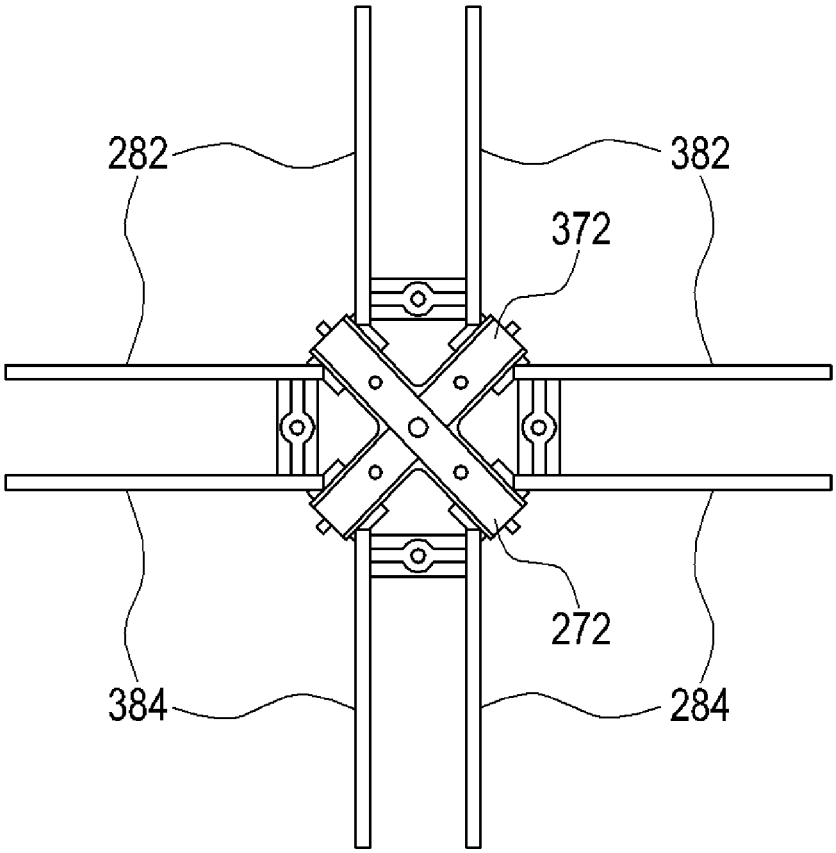
FIG. 5 is a fourth exemplary configuration view of the conventional dipole-type dual-polarized radiating element.
Figure 8:
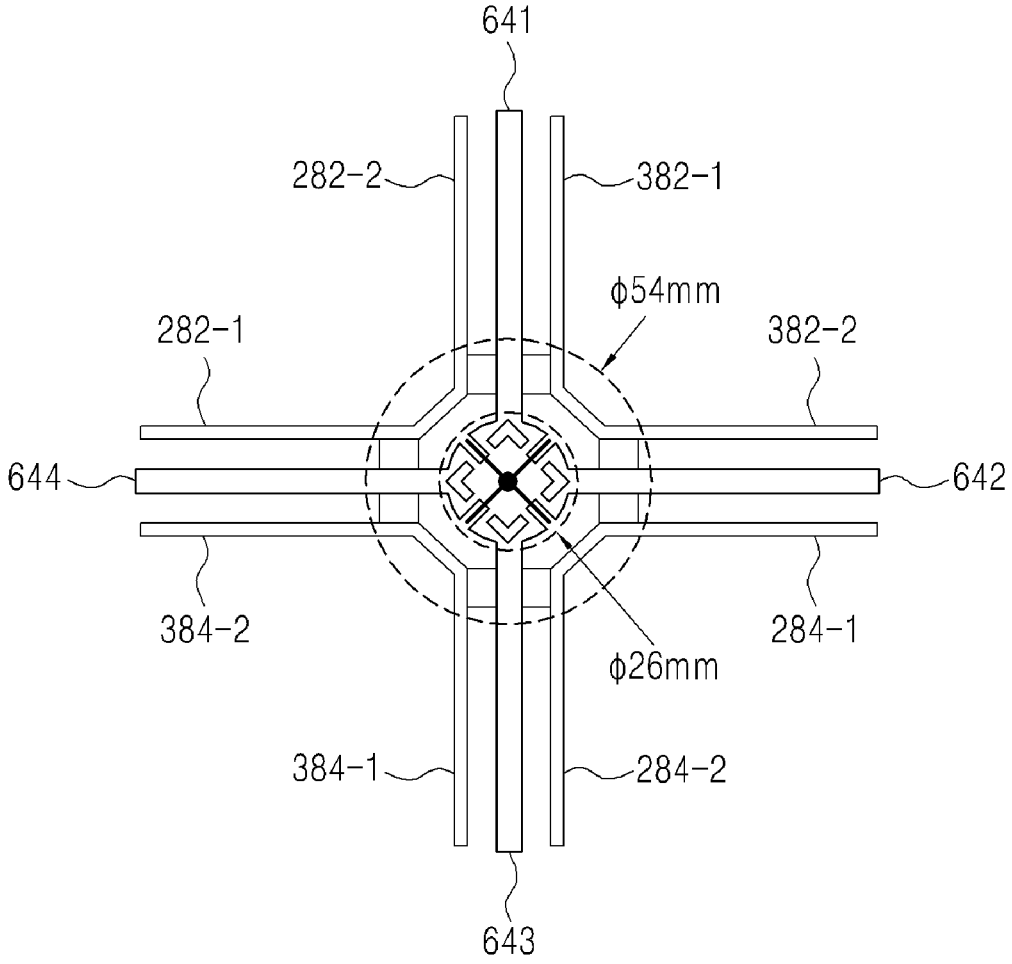
FIG. 8 is a comparison view between the dipole-type dual-polarized radiating element in accordance with some embodiments of the present disclosure and the conventional radiating element.

FIG. 8 is a comparison view of the dipole-type dual-polarized radiating element in accordance with some embodiments of the present disclosure and the conventional radiating element, and illustrates the conventional one exemplary structure (the plane structure) as illustrated in FIG. 5 that can be most similar to the structure of the present disclosure, and the structure (the plane structure) in accordance with the second embodiment of the present disclosure as illustrated in FIGS. 7A to 7D to be overlapped therebetween. The conventional one exemplary structure illustrated in FIG. 8 and one exemplary structure of the present disclosure can be regarded as an advantageous structure for reducing the mutual signal interference between the radiating elements of different bands and optimizing overall size of the antenna, when designing a multi-band antenna in which the radiating elements of different bands are installed at adjacent location.

As illustrated in FIG. 8, the structure in accordance with the conventional embodiment that can be composed of a 1-1 radiating arm 282-1, 282-2, a 1-2 radiating arm 284-1, 284-2, a 2-1 radiating arm 382-1, 382-2, and a 2-2 radiating arm 384-1, 384-2 should design a diameter of the conductor of the central portion thereof, for example, as 54 mm when designing for processing 800 MHz band, for example, while the structure in accordance with the embodiment of the present disclosure can design a diameter of the conductor of the central portion thereof, for example, as 26 mm. In the conventional embodiment, since this should be independently provided with the feeding line between two radiating arms that are substantially independent, respectively, a wide ground area corresponding to two striplines should be obtained, for example. Accordingly, the body of the feeding structure has to be large in the conventional embodiment.

Furthermore, as illustrated in FIG. 8, the structure in accordance with the conventional one embodiment can be also seen to have eight structures substantially corresponding to the radiating arms, and it can be seen that in the embodiment of the present disclosure, only four radiating arms overall placed in a '+' shape are used to generate the X-polarized wave. As a result, the structure in accordance with the embodiment of the present disclosure can reduce the number of the structures corresponding to the radiating arms by a half, and reduce the area required to install the structure corresponding to each radiating arm, compared with the conventional structure.

It will be understood that the structures in accordance with the embodiments of the present disclosure are very advantageous in the multi-band antenna structure in which the demand is recently increasing rapidly. Since the multi-band antenna processes a plurality of frequency bands in one antenna, and includes a plurality of radiating elements for each band, it is not easy to sufficiently obtain the distance between the radiating elements due to the limited size of the antenna. Particularly, the antenna radiating pattern as well as electrical characteristics (VSWR, Isolation, etc.) can have a significant influence due to the influence between the adjacent radiating elements in different bands.

Figure 9:
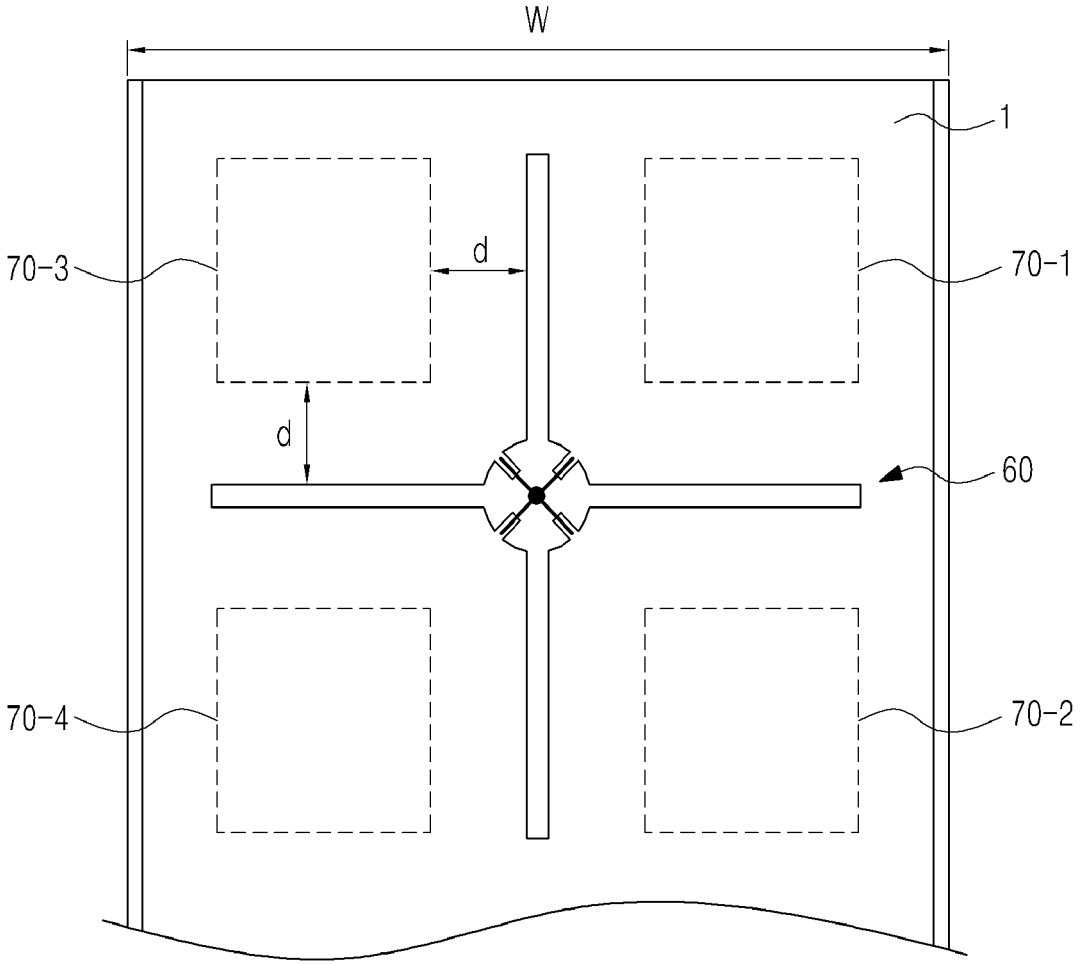
FIG. 9 is a configuration view of the main portion of a wireless communication antenna having the dipole-type dual-polarized radiating element in accordance with some embodiments of the present disclosure.

FIG. 9 is a configuration view of the main portion of the multi-band wireless communication antenna having the dipole-type dual-polarized radiating element in accordance with some embodiments of the present disclosure, and for example, illustrates that a first radiating element 60 of the structure in accordance with the second embodiment of the present disclosure as illustrated in FIGS. 7A to 7D is installed on a reflector 1 as the radiating element of the first band (e.g., 800 MHz band). Furthermore, second or third radiating elements 70-1, 70-2, 70-3, 70-4 of a second band (e.g., 2 GHz band) or a third band (e.g., 2.5 GHz band) can be installed at the upper and lower sides of the left and right sides of the first radiating element 60. That is, if the arrangement structure of the entire antenna system is a square shape, the second or third radiating elements 70-1, 70-2, 70-3, 70-4 are installed at each edge portion of the square shape, and the first radiating element 60 is installed at the central portion thereof.

In this case, the interval (d) between the radiating arms of the first radiating element 60 and the second or third radiating elements 70-1, 70-2, 70-3, 70-4 can be sufficiently obtained or reduced while reducing the signal interference between the radiating elements, compared to the conventional example illustrated in FIG. 8, thus overall enhancing the characteristic of the antenna. Furthermore, the width (w) of the reflector 1 of the corresponding antenna can be further reduced, compared to the conventional example, thus further optimizing the size and structure of the entire antenna.

Meanwhile, in the above, the second or third radiating elements 70-1, 70-2, 70-3, 70-4 can, of course, have a radiating element structure in accordance with the embodiments of the present disclosure illustrated in FIGS. 6 to 7D. Furthermore, other than the above, the second or third radiating elements 70-1, 70-2, 70-3, 70-4 can adopt the structure of the dipole-type radiating element in the conventional various methods, and the entire outer shape thereof also has various shapes, such as a square, a 'X' shape, or a diamond.

As described above, the configuration and the operation of the multi-polarized radiating element and the antenna having the same in accordance with an embodiment of the present disclosure can be made, and meanwhile, the present disclosure describes the detailed embodiments, but various modifications can be performed without departing from the scope of the present disclosure.

For example, the above description described that the radiating arms constituting the radiating elements of the present disclosure had, for example, a '1'-shaped rod structure, but in other embodiments of the present disclosure, other than the above, the radiating arms can have a polygon such as a square (diamond) or a ring shape of a circle, or can be also implemented in a plate shape of a square, etc.

Furthermore, the second embodiment of the present disclosure illustrated in FIGS. 7A to 7D described that the first and second feeding lines were configured using the stripline structure, but other than the above, the cross-sectional shape of the first and second feeding lines can be also implemented by various shapes, such as a circle, a square, etc., of conductor lines.

Thus, various modifications and changes of the present disclosure can be made, and therefore, the scope of the present disclosure should be defined by the following claims and their equivalents, rather than by the above-descried embodiments.

What is claimed is:

1. A multi-polarized radiating element, comprising:

first, second, third, and fourth radiating arms sequentially arranged clockwise in a four-way symmetrical manner on a plane about a vertical axis when viewed from above;

a first feeding line comprising a first inner conductor and a first outer conductor surrounding the first inner conductor, wherein the first inner conductor is fed in common to the fourth radiating arm and the first radiating arm, and the first outer conductor is grounded in common to the second radiating arm and the third radiating arm; and a second feeding line comprising a second inner conductor and a second outer conductor surrounding the second inner conductor, wherein the second inner conductor is fed in common to the first radiating arm and the second radiating arm, and the second outer conductor is grounded in common to the third radiating arm and the fourth radiating arm, wherein a vector sum of currents generated along the first and second radiating arms, respectively, is formed in a direction at 45 degrees clockwise from the first arm with respect to the vertical axis, and a vector sum of currents generated along the first and fourth radiating arms, respectively, is formed in a direction at 45 degrees counterclockwise from the first arm with respect to the vertical axis.

2. The multi-polarized radiating element of claim 1, wherein each of the first to fourth radiating arms is individually supported by a support fixture forming a balun structure, and wherein the support fixtures supporting the first to fourth radiating arms are installed to be spaced at a pre-designed interval apart from each other.

3. The multi-polarized radiating element of claim 2, wherein each of the first feeding line and the second feeding line has a structure of a stripline transmission line having a first stripline and a second stripline as a feeding conductor portion, respectively, wherein the first stripline is installed in the shape that is placed between the support fixture of the second radiating arm and the support fixture of the third radiating arm, and is extended between the support fixture of the fourth radiating arm and the support fixture of the first radiating arm to deliver a feeding signal in common to the fourth radiating arm and the first radiating arm in a capacitance coupling method, and wherein the second stripline is installed in the shape that is placed between the support fixture of the third radiating arm and the support fixture of the fourth radiating arm, and is extended between the support fixture of the first radiating arm and the support fixture of the second radiating arm to deliver a feeding signal in common to the first radiating arm and the second radiating arm in a capacitance coupling method.

4. The multi-polarized radiating element of claim 1, wherein each of the first feeding line and the second feeding line has a balun structure comprising a coaxial line, wherein the first inner conductor of the first feeding line is connected in common to the fourth radiating arm and the first radiating arm, and the first outer conductor of the first feeding line is connected in common to the second radiating arm and the third radiating arm, and wherein the second inner conductor of the second feeding line is connected in common to the first radiating arm and the second radiating arm, and the second outer conductor of the second feeding line is connected in common to the third radiating arm and the fourth radiating arm.

5. The multi-polarized radiating element of claim 1, wherein the arrangements of the first to fourth radiating elements overall indicate a 'V' shape on a plane.

6. An antenna having a multi-polarized radiating element, comprising:

a reflector;

at least one first radiating element of a first band installed on the reflector; and at least one second or third radiating element of a second band or a third band installed on the reflector, wherein the first radiating element comprises:

first, second, third, and fourth radiating arms sequentially arranged clockwise in a four-way symmetrical manner on a plane about a vertical axis when viewed from above, a first feeding line comprising a first inner conductor and a first outer conductor surrounding the first inner conductor, wherein the first inner conductor is fed in common to the fourth radiating arm and the first radiating arm, and the first outer conductor is grounded in common to the second radiating arm and the third radiating arm, and a second feeding line comprising a second inner conductor and a second outer conductor surrounding the second inner conductor, wherein the second inner conductor is fed in common to the first radiating arm and the second radiating arm, and the second outer conductor is grounded in common to the third radiating arm and the fourth radiating arm, wherein a vector sum of currents generated along the first and second radiating arms, respectively, is formed in a direction at 45 degrees clockwise from the first arm with respect to the vertical axis, and a vector sum of currents generated along the first and fourth radiating arms, respectively, is formed in a direction at 45 degrees counterclockwise from the first arm with respect to the vertical axis.

7. The multi-polarized radiating element of claim 2, wherein the arrangements of the first to fourth radiating elements overall indicate a 'V' shape on a plane.

8. The multi-polarized radiating element of claim 3, wherein the arrangements of the first to fourth radiating elements overall indicate a 'V' shape on a plane.

9. The multi-polarized radiating element of claim 4, wherein the arrangements of the first to fourth radiating elements overall indicate a 'V' shape on a plane.

* * * * *